US011158182B1

(12) United States Patent
Pettway

(10) Patent No.: US 11,158,182 B1
(45) Date of Patent: Oct. 26, 2021

(54) EARTHQUAKE ALARM ASSEMBLY

(71) Applicant: Randy Pettway, San Bernardino, CA (US)

(72) Inventor: Randy Pettway, San Bernardino, CA (US)

( * ) Notice: Subject to any disclaimer, the term of this patent is extended or adjusted under 35 U.S.C. 154(b) by 0 days.

(21) Appl. No.: 17/009,889

(22) Filed: Sep. 2, 2020

(51) Int. Cl.
*G08B 21/10* (2006.01)
*G08B 7/06* (2006.01)

(52) U.S. Cl.
CPC ..... *G08B 21/10* (2013.01); *G08B 7/06* (2013.01)

(58) Field of Classification Search
CPC ..... G08B 21/10; G08B 7/06
USPC ..... 340/690
See application file for complete search history.

(56) References Cited

U.S. PATENT DOCUMENTS 5,001,466 A * 3/1991 Orlinsky ..... G01V 1/008 200/61.47
5,101,195 A 3/1992 Caillat
D350,903 S * 9/1994 Chern ..... D10/106.1
5,539,387 A 7/1996 Gitlis
5,760,696 A 6/1998 Sadri
6,342,842 B2 1/2002 Chen
6,356,204 B1 3/2002 Guindi
6,873,256 B2 * 3/2005 Lemelson ..... G08B 7/066 340/511
7,463,162 B1 12/2008 Hosseini
7,755,481 B2 * 7/2010 Gayden ..... G08B 7/06 340/539.26
8,488,416 B2 * 7/2013 Nasser ..... G01V 1/008 367/178
10,475,322 B1 11/2019 Wang
2006/0042177 A1 3/2006 Lin
2012/0262299 A1 10/2012 Hung
2012/0319839 A1 12/2012 Shin

FOREIGN PATENT DOCUMENTS

WO WO2019052280 3/2019

* cited by examiner

*Primary Examiner* — John A Tweel, Jr.

(57) ABSTRACT

An earthquake alarm assembly includes a disk that can be mounted to a wall in a building. A motion sensor is positioned in the disk and the motion sensor senses acceleration and deceleration of the disk to sense when the disk is being moved due to an earthquake. A speaker is positioned in the disk and the speaker is turned on to emit an audible alert when the motion sensor senses motion of the disk. In this way the speaker can alert occupants of the building that an earthquake is occurring. A plurality of intensity indicators is each coupled to the disk and a respective one of the intensity indicators is turned on to communicate the intensity of the earthquake to the occupants of the building.

6 Claims, 3 Drawing Sheets

EARTHQUAKE ALARM ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to alarm devices and more particularly pertains to a new alarm device for alerting occupants of a building that an earthquake is occurring.

(2) Description of Related Art Including Information Disclosed Under 37 CFR 1.97 and 1.98

The prior art relates to alarm devices including an earthquake sensor that includes a cantilevered beam for sensing vibrations below a frequency of 14 Hz. The prior art discloses an earthquake sensor that includes a sensor which rests on a pin for detecting motion. The prior art disclose circuitry for analyzing vibration signals to differentiate between conventional earthquake tremors and precursor tremors. The prior art discloses an earthquake sensor that includes a spring under tension that engages a sensor. The prior art discloses a variety of earthquake sensors that employ vibration sensors for detecting earthquake vibrations.

BRIEF SUMMARY OF THE INVENTION

An embodiment of the disclosure meets the needs presented above by generally comprising a disk that can be mounted to a wall in a building. A motion sensor is positioned in the disk and the motion sensor senses acceleration and deceleration of the disk to sense when the disk is being moved due to an earthquake. A speaker is positioned in the disk and the speaker is turned on to emit an audible alert when the motion sensor senses motion of the disk. In this way the speaker can alert occupants of the building that an earthquake is occurring. A plurality of intensity indicators is each coupled to the disk and a respective one of the intensity indicators is turned on to communicate the intensity of the earthquake to the occupants of the building.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
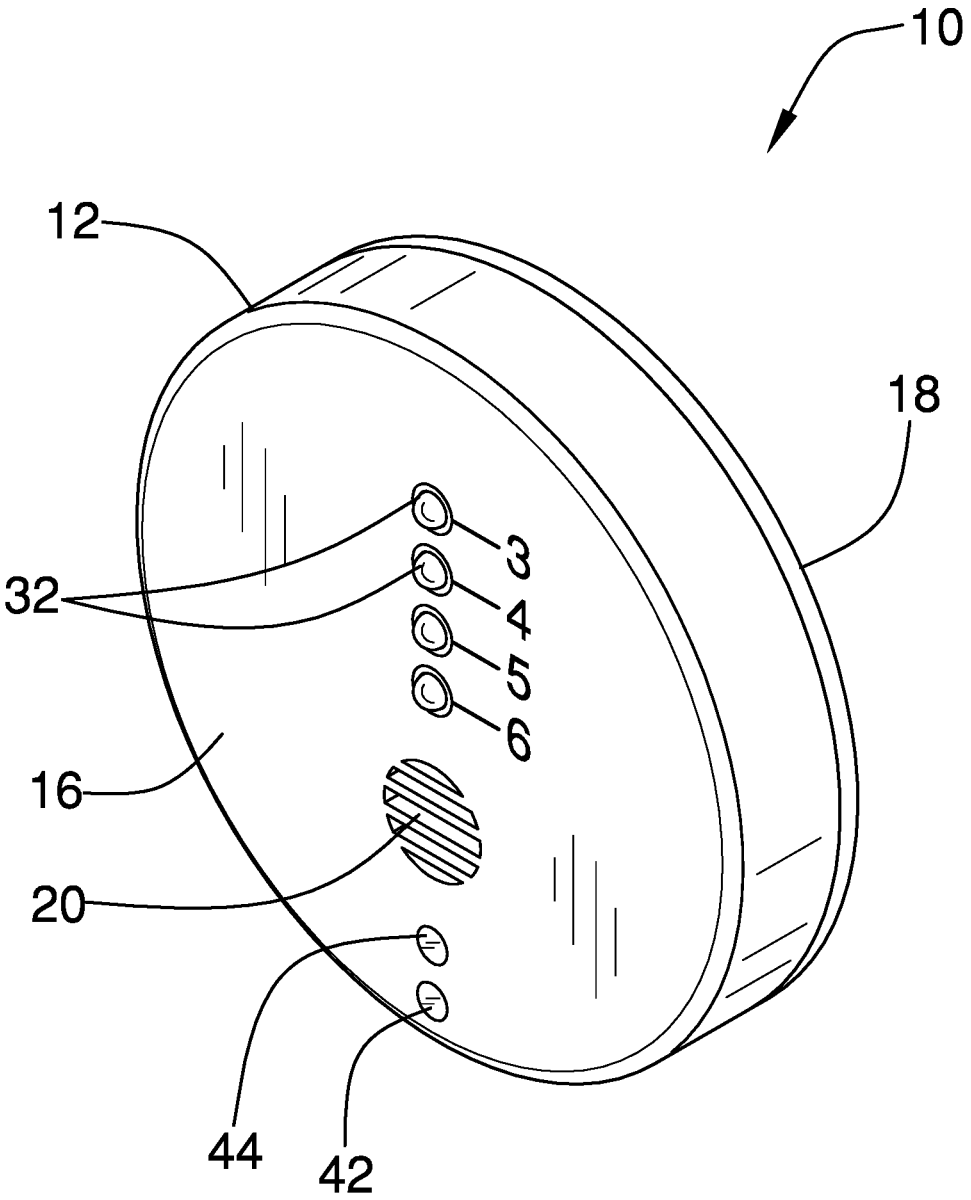
FIG. 1 is a front perspective view of an earthquake alarm assembly according to an embodiment of the disclosure.
Figure 4:
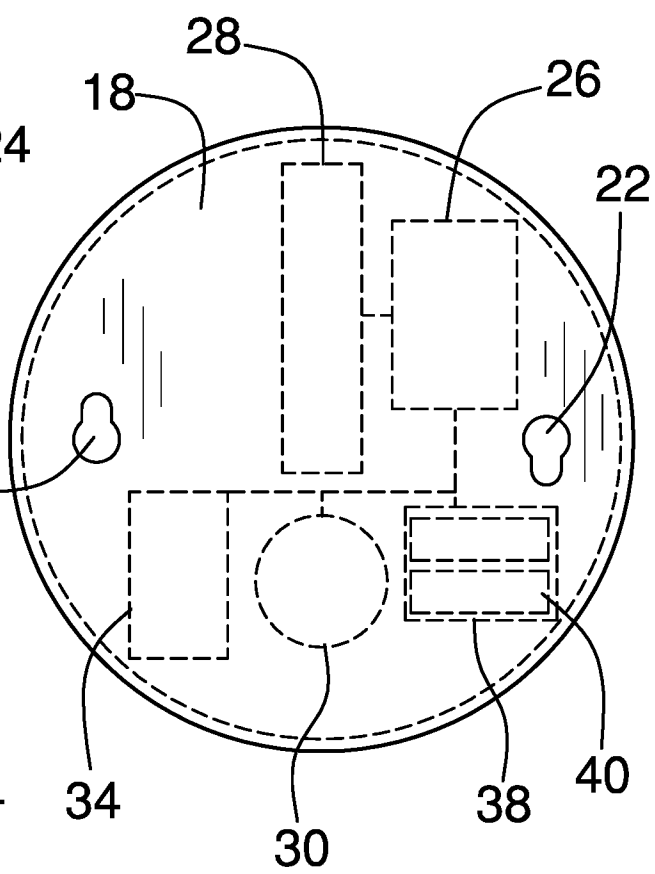
FIG. 4 is a back perspective view of an embodiment of the disclosure.
Figure 3:
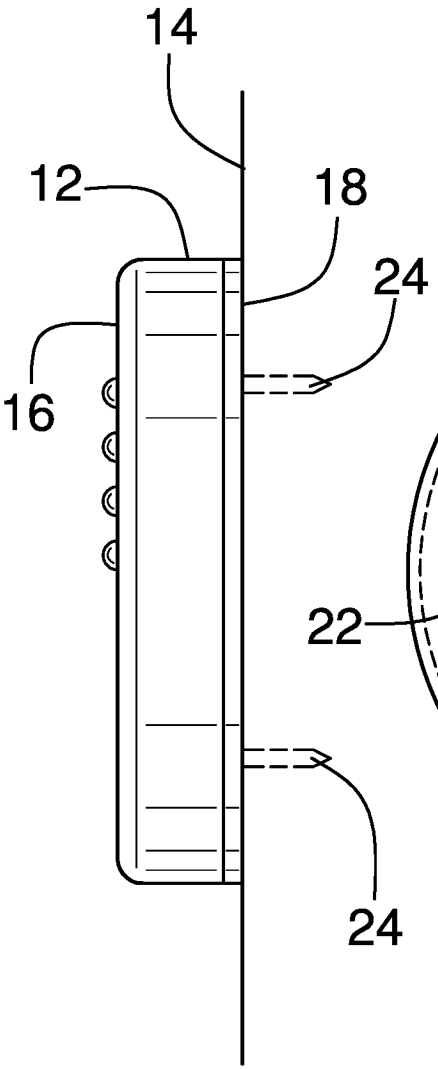
FIG. 3 is a right side view of an embodiment of the disclosure.
Figure 2:
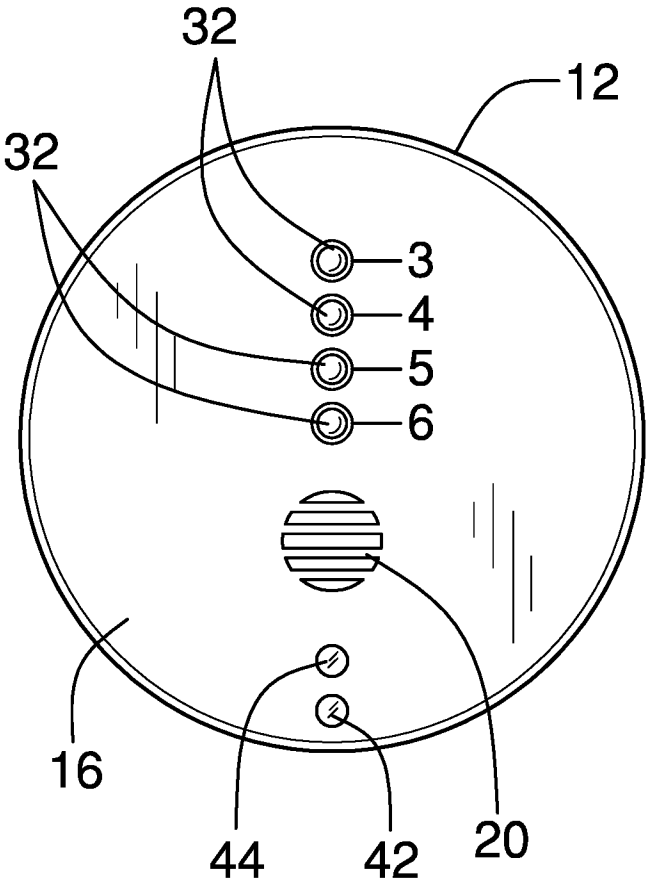
FIG. 2 is a front view of an embodiment of the disclosure.
Figure 5:
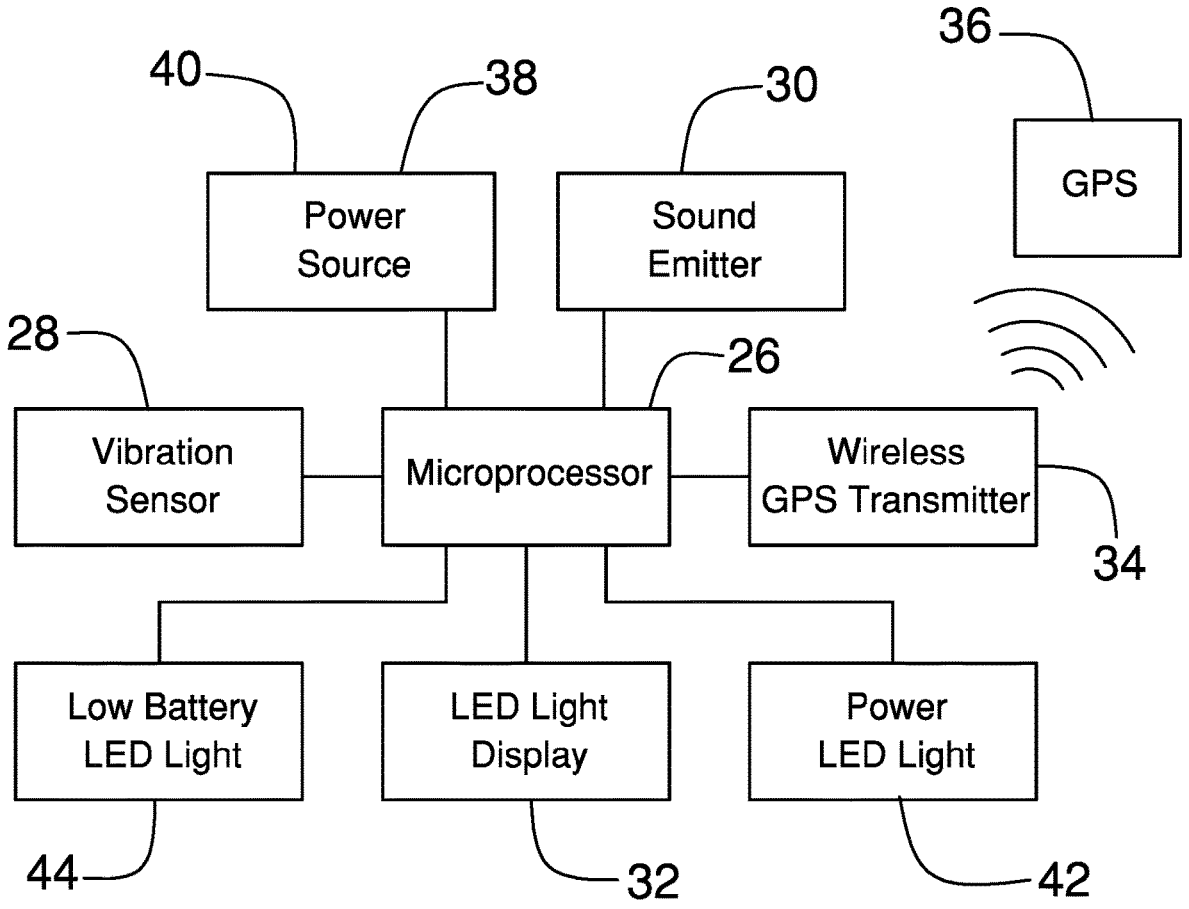
FIG. 5 is a schematic view of an embodiment of the disclosure.

With reference now to the drawings, and in particular to FIGS. 1 through 5 thereof, a new alarm device embodying the principles and concepts of an embodiment of the disclosure and generally designated by the reference numeral 10 will be described.

As best illustrated in FIGS. 1 through 5, the earthquake alarm assembly 10 generally comprises a disk 12 that can be mounted to a wall 14 in a building. The building may be a house, an office building or any other building that is commonly occupied by people. The disk 12 has a front wall 16 and a back wall 18, the disk 12 is hollow, and the front wall 16 has a speaker opening 20 extending into an interior of the disk 12. The back wall 18 has a plurality of engagements 22 thereon to engage a support 24 on the wall 14 for retaining the disk 12 on the wall 14. The support 24 might be a nail in the wall 14 and each of the engagements 22 may comprise a slot in the back wall 18 that receives the nail.

A control circuit 26 is positioned in the disk 12 and the control circuit 26 receives an alert input. A motion sensor 28 is positioned in the disk 12 and the motion sensor 28 senses acceleration and deceleration of the disk 12. In this way the motion sensor 28 can sense when the disk 12 is being moved due to an earthquake. The motion sensor 28 is electrically coupled to the control circuit 26 and the control circuit 26 receives the alert input when the motion sensor 28 senses motion of the disk 12. The motion sensor 28 may comprise an electronic motion sensor such as an accelerometer or the like.

A speaker 30 is positioned in the disk 12 and the speaker 30 is in communication with the motion sensor 28. The speaker 30 is turned on to emit an audible alert when the motion sensor 28 senses motion of the disk 12 to alert occupants of the building that an earthquake is occurring. In this way the occupants can take appropriate evasive action as soon as an earthquake occurs. The speaker 30 is electrically coupled to the control circuit 26 and the speaker 30 is turned on when the control circuit 26 receives the alert input. Additionally, the speaker 30 is aligned with the speaker opening 20 in the front wall 16 of the disk 12.

A plurality of intensity indicators 32 is each coupled to the disk 12 to emit a visual alert. Each of the intensity indicators 32 is assigned a value ranging between a minimum intensity and a maximum intensity. Moreover, a respective one of the intensity indicators 32 is turned on when the motion sensor 28 senses motion of the disk 12. In this way the respective intensity indicator 32 communicates the intensity of the earthquake to the occupants of the building. Each of the intensity indicators 32 is positioned on the front wall 16 of the disk 12 and the plurality of intensity indicators 32 is vertically distributed on the front wall 16. The plurality of intensity indicators 32 is electrically coupled to the control circuit 26 and the control circuit 26 analyzes data from the motion sensor 28 for determining which of the intensity indicators 32 should be actuated. Each of the intensity indicators 32 may comprise an LED or other type of light emitter.

A transceiver 34 is positioned in the disk 12 and the transceiver 34 is electrically coupled to the control circuit 26. The transceiver 34 is in wireless communication with a global positioning system (gps) 36 such that the transceiver 34 receives position data from the gps 36. The transceiver 34 may be a radio frequency transceiver or the like and the transceiver 34 might facilitate search and rescue teams to locate the transceiver 34 in the event that the building in which the disk 12 is positioned suffers structural collapse.

A power supply 38 is integrated into the disk 12 and the power supply 38 is electrically coupled to the control circuit 26. The power supply 38 comprises at least one battery 40 that is positioned in the disk 12 and the at least one battery 40 is electrically coupled to the control circuit 26. The power supply 38 includes a power indicator 42 that is positioned on the front wall 16 of the disk 12 to emit a visual alert. The power indicator 42 is electrically coupled to the control circuit 26 and the power indicator 42 is turned on when the control circuit 26 receives power from the at least one battery 40. The power supply 38 includes a low battery indicator 44 that is positioned on the front wall 16 of the disk 12 to emit a visual alert. The low battery indicator 44 is electrically coupled to the control circuit 26 and the low battery indicator 44 is turned on when the capacity of the at least one battery 40 falls below a pre-determined threshold to indicate when it is time to replace the at least one battery 40. Each of the power indicator 42 and the low battery indicator 44 may comprise an LED or other type of electronic light emitter.

In use, the disk 12 is mounted in a conspicuous location in the building such that the speaker 30 is audible to the occupants and the intensity indicators 32 are visible to the occupants. The respective intensity indicator 32 is turned on when the motion sensor 28 senses motion and the speaker 30 emits the audible alert. In this way the occupants are alerted that an earthquake is occurring and the occupants are alerted to the intensity of the earthquake. In this way the occupants can take appropriate safety measures to protect themselves against injury during the earthquake. Additionally, the motion sensor 28 has a sensitivity range to facilitate the motion sensor 28 to sense earthquake motion that may not be perceptible to the occupants. In this way the occupants can take shelter in advance of stronger earthquake activity that may have otherwise caught them unprepared.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An earthquake alarm assembly for notifying occupants of a building that an earthquake is occurring, said assembly comprising:

a disk being configured to be mounted to a wall in a building;

a control circuit being positioned in said disk, said control circuit receiving an alert input;

a motion sensor being positioned in said disk, said motion sensor sensing acceleration and deceleration of said disk wherein said motion sensor is configured to sense when said disk is being moved due to an earthquake; said motion sensor being electrically coupled to said control circuit, said control circuit receiving said alert input when said motion sensor senses motion of said disk;

a speaker being positioned in said disk, said speaker being in communication with said motion sensor, said speaker being turned on to emit an audible alert when said motion sensor senses motion of said disk wherein said speaker is configured to alert occupants of the building that an earthquake is occurring;

a power indicator being positioned on said front wall of said disk wherein said power indicator is configured to emit a visual alert; and a plurality of intensity indicators, each of said intensity indicators being coupled to said disk wherein each of said intensity indicators is configured to emit a visual alert, each of said intensity indicators being assigned a value ranging between a minimum intensity and a maximum intensity, a respective one of said intensity indicators being turned on when said motion sensor senses motion of said disk wherein said respective indicator is configured to communicate the intensity of the earthquake to the occupants of the building, each of said intensity indicators being positioned on a front wall of said disk, said plurality of intensity indicators being vertically distributed on said front wall spaced above and in vertical alignment with said power indicator wherein a distance between said power indicator and an activated one of said intensity indicators provides an additional indication of the intensity of the earthquake, said plurality of intensity indicators being electrically coupled to said control circuit, said control circuit analyzing data from said motion sensor for determining which of said intensity indicators should be actuated.

2. The assembly according to claim 1, wherein said disk has a front wall and a back wall, said disk being hollow, said front wall having a speaker opening extending into an interior of said disk, said back wall having a plurality of engagements thereon wherein each of said engagements is configured to engage a support on the wall for retaining said disk on the wall.

3. The assembly according to claim 1, wherein said speaker is electrically coupled to said control circuit, said speaker being turned on when said control circuit receives said alert input.

4. The assembly according to claim 1, further comprising a transceiver being positioned in said disk, said transceiver being electrically coupled to said control circuit, said transceiver being in wireless communication with a global positioning system (gps) wherein said transceiver is configured to receive position data from said gps.

5. The assembly according to claim 1, further comprising a power supply being integrated into said disk, said power supply being electrically coupled to said control circuit, said power supply comprising:

at least one battery being positioned in said disk, said at least one battery being electrically coupled to said control circuit;

said power indicator being electrically coupled to said control circuit, said power indicator being turned on when said control circuit receives power from said at least one battery; and a low battery indicator being positioned on said front wall of said disk wherein said low battery indicator is configured to emit a visual alert, said low battery indicator being electrically coupled to said control circuit, said low battery indicator being turned on when the capacity of said at least one battery falls below a pre-determined threshold wherein said low battery indicator is configured to indicate when it is time to replace said at least one battery.

6. An earthquake alarm assembly for notifying occupants of a building that an earthquake is occurring, said assembly comprising:

a disk being configured to be mounted to a wall in a building, said disk having a front wall and a back wall, said disk being hollow, said front wall having a speaker opening extending into an interior of said disk, said back wall having a plurality of engagements thereon wherein each of said engagements is configured to engage a support on the wall for retaining said disk on the wall;

a control circuit being positioned in said disk, said control circuit receiving an alert input;

a motion sensor being positioned in said disk, said motion sensor sensing acceleration and deceleration of said disk wherein said motion sensor is configured to sense when said disk is being moved due to an earthquake, said motion sensor being electrically coupled to said control circuit, said control circuit receiving said alert input when said motion sensor senses motion of said disk;

a speaker being positioned in said disk, said speaker being in communication with said motion sensor, said speaker being turned on to emit an audible alert when said motion sensor senses motion of said disk wherein said speaker is configured to alert occupants of the building that an earthquake is occurring, said speaker being electrically coupled to said control circuit, said speaker being turned on when said control circuit receives said alert input;

a power indicator being positioned on said front wall of said disk wherein said power indicator is configured to emit a visual alert;

a plurality of intensity indicators, each of said intensity indicators being coupled to said disk wherein each of said intensity indicators is configured to emit a visual alert, each of said intensity indicators being assigned a value ranging between a minimum intensity and a maximum intensity, a respective one of said intensity indicators being turned on when said motion sensor senses motion of said disk wherein said respective indicator is configured to communicate the intensity of the earthquake to the occupants of the building, each of said intensity indicators being positioned on said front wall of said disk spaced above and in vertical alignment with said power indicator wherein a distance between said power indicator and an activated one of said intensity indicators provides an additional indication of the intensity of the earthquake, said plurality of intensity indicators being vertically distributed on said front wall, said plurality of intensity indicators being electrically coupled to said control circuit, said control circuit analyzing data from said motion sensor for determining which of said intensity indicators should be actuated;

a transceiver being positioned in said disk, said transceiver being electrically coupled to said control circuit, said transceiver being in wireless communication with a global positioning system (gps) wherein said transceiver is configured to receive position data from said gps; and a power supply being integrated into said disk, said power supply being electrically coupled to said control circuit, said power supply comprising:

at least one battery being positioned in said disk, said at least one battery being electrically coupled to said control circuit;

said power indicator being electrically coupled to said control circuit, said power indicator being turned on when said control circuit receives power from said at least one battery; and a low battery indicator being positioned on said front wall of said disk wherein said low battery indicator is configured to emit a visual alert, said low battery indicator being electrically coupled to said control circuit, said low battery indicator being turned on when the capacity of said at least one battery falls below a pre-determined threshold wherein said low battery indicator is configured to indicate when it is time to replace said at least one battery.

* * * * *